United States Patent [19]

Moody

[11] Patent Number: 5,025,744

[45] Date of Patent: Jun. 25, 1991

[54] SUBMARINE TORPEDO TUBE AXIAL WEAPON RESTRAINER

[75] Inventor: Paul E. Moody, Barrington, R.I.

[73] Assignee: The United States of America as represented by the Secretary of the Navy, Washington, D.C.

[21] Appl. No.: 566,920

[22] Filed: Aug. 14, 1990

[51] Int. Cl.[5] ..... B63G 8/32

[52] U.S. Cl. ..... 114/238; 89/1.806

[58] Field of Search ..... 114/238, 239, 18, 20 R, 114/312, 316, 320; 102/259; 89/1.806

[56] References Cited

U.S. PATENT DOCUMENTS

| | | | |
|---|---|---|---|
| 2,137,056 | 11/1938 | Liegeois | 102/259 |
| 3,048,111 | 8/1962 | Baker | 102/259 |
| 3,893,366 | 7/1975 | Murray | 89/1.806 |
| 3,983,785 | 10/1976 | Dissameyer | 89/1.806 |
| 4,616,554 | 10/1986 | Spink | 89/1.806 |

*Primary Examiner*—Joseph F. Peters, Jr.
*Assistant Examiner*—Clifford T. Bartz
*Attorney, Agent, or Firm*—Michael J. McGowan; Prithvi C. Lall; Michael F. Oglo

[57] ABSTRACT

A submarine torpedo tube axial weapon restrainer for preventing a weapon from moving breechward in a torpedo tube once the weapon has been released for firing. An axial restrainer block is mounted within a housing on a wall of a torpedo tube. The block has a guide slot that extend into the torpedo tube for engaging a guide stud of a weapon to be loaded into the tube. The housing is provided with cam slots that allow the block to move axially along the torpedo tube. The cam slots permit the block's guide slot to receive, engage or release the weapon guide stud in one of a load, lock or fire position, respectively. A hydraulic control system having three power cylinders controls the movement of the block. A first power cylinder mechanically connected to the block moves the block. Second and third power cylinders are used to control the amount of movement of the first power cylinder toward the breechward and/or muzzleward end of the torpedo tube. In the critical firing situation, the second power cylinder ensures that the first power cylinder is only permitted to move towards the muzzleward end of the torpedo tube.

11 Claims, 3 Drawing Sheets

SUBMARINE TORPEDO TUBE AXIAL WEAPON RESTRAINER

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention generally relates to submarine torpedo tube systems and more particularly to a submarine torpedo tube axial weapon restrainer that prevents a weapon from moving breechward in a torpedo tube once the weapon has been released for firing.

(2) Description of the Prior Art

A submarine torpedo tube has a breechward and muzzleward end. A weapon is loaded into the torpedo tube's breechward end and fired from its muzzleward end. Every weapon has a guide stud mounted on its exterior surface which is used for axially positioning the weapon in the torpedo tube. This guide stud travels axially through a guide slot which is located on the top centerline of the torpedo tube barrel. The guide slot prevents rotation of the weapon as it is loaded into, and fired out of the torpedo tube. An axial weapon restraining system is used to engage the weapon's guide stud in its forward/aft position in order to secure the weapon in the torpedo tube until just prior to firing.

Conventional weapon restraining systems utilize two stop bolts, a muzzleward bolt and a breechward bolt, that are rotated through the wall of the torpedo tube fore and aft of the guide stud thereby maintaining the weapon's axial position in the tube. Upon loading the weapon into the tube the breechward stop bolt is rotated out of the guide slot while the muzzleward stop bolt is positioned in the guide slot. When a weapon is loaded into the torpedo tube it is positioned axially by the weapon's guide stud contacting the muzzleward stop bolt. Once the weapon is positioned, it is locked in place by rotating the breechward stop bolt behind the guide stud. This action secures the weapon from movement prior to the system being fired. Upon firing the weapon from the tube, the two stop bolts are rotated up and out of the torpedo tube guide slot. This action permits the guide stud, and therefore the weapon, to move axially within the torpedo tube.

Unfortunately, with the introduction of the turbine pump ejection system, a flow path was introduced into the system which would permit water to flow from the torpedo tube muzzle door to the breechward end of the torpedo tube which is connected via a connecting tank to the ejection pump door. Water flow travels breechward in the torpedo tube as a result of a greater hydrostatic pressure head at the torpedo tube muzzle door than at the ejection pump door. This is a result of the ship's design constraints which cannot be easily modified. This pressure differential and breechward flow results in a force which will tend to move the weapon breechward once the breechward stop bolt is lifted. However, the breechward bolt must be removed from aft of the guide stud prior to a weapon aft guide stud travelling through the axial restraining system area.

SUMMARY OF THE INVENTION

Accordingly, it is an object of the present invention to provide a submarine torpedo tube axial weapon restrainer that prevents a weapon from moving breechward in a torpedo tube once it has been released for firing.

Another object of the present invention is to provide a submarine torpedo tube axial weapon restrainer that can operate within the submarine's design constraints.

It is a further object of the present invention to provide a submarine torpedo tube axial weapon restrainer that causes minimal flow restrictions within the torpedo tube.

Other objects and advantages of the present invention will become more apparent hereinafter in the specification and drawings.

In accordance with the present invention, an axial weapon restrainer is mounted within a housing. The housing is mounted on a wall of a torpedo tube. A portion of the restrainer extends into the torpedo tube and has a guide slot that will engage a guide stud on a weapon stowed on a torpedo tube. The restrainer has guide pins that extend into cam slots that have been cut into the wall housing. The cam slots permit movement of the restrainer in both the axial direction of the torpedo tube and perpendicular to the axis of the tube so that the guide slot can be raised or lowered over the guide stud. The cam slots are such that as the restrainer moves toward the breechward end of the torpedo tube to facilitate loading of a weapon, the restrainer is positioned to receive the weapon guide stud from the breechward end of the torpedo tube. And to prevent muzzleward movement of the guide stud beyond the restrainer. Similarly, as the restrainer moves toward the muzzleward end during the firing of the weapon, the restrainer is positioned to release the guide stud toward the muzzleward end of the torpedo tube. A first power cylinder attached to the restrainer moves the restrainer within the cam slots. A second power cylinder limits the amount of movement of the first power cylinder in the breechward direction and a third power cylinder limits the movement of the first power cylinder in the muzzleward direction. Movement of all three power cylinders is controlled by a hydraulic pressure system that acts in response to a load, look or fire control signal.

DESCRIPTION OF THE PREFERRED EMBODIMENTS

Figure 1:
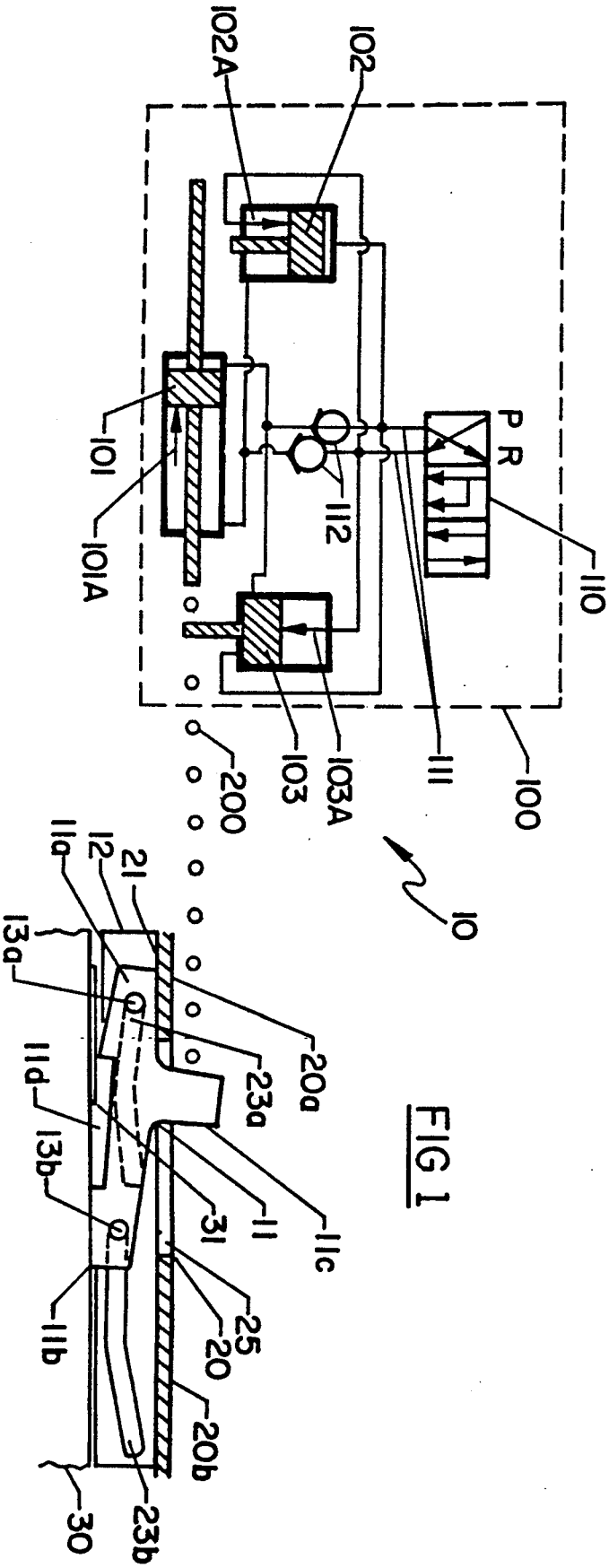
FIG. 1 is a schematic of the axial weapon restraining system of the present invention in the load position.

Referring now to the drawings and in particular to FIG. 1, there is shown an axial weapon restraining system 10 in the load position according to the present invention. The axial restrainer block 11, shown in a side-view, is mounted within a cam housing 12 on an inside wall 21 of a torpedo tube 20. Torpedo tube 20 has a breechward end 20*a* and a muzzleward end 20*b*. Note that tube 20 is shown only in section.

Block 11 has a retraining block section 11*c* passing through an opening 25 cut into the torpedo tube 20. Block 11 also has a breechward section 11*a* and a muzzleward section 11*b*. Breechward refers to the aft portion of the torpedo tube where a weapon is loaded and muzzleward refers to the forward portion of the torpedo tube where the weapon exits the torpedo tube. Two guide pins 13*a* and 13*b* pass through and extend from block 13 in the breechward and muzzleward sections 11*a* and 11*b*, respectively. Guide pins 13*a* and 13*b* extend into cam slots 23*a* and 23*b* cut into the housing 12.

Cam slots 23*a* and 23*b* permit movement of block 11 from the breechward end 20*a* to the muzzleward end 20*b* of tube 20. Hereinafter, this movement will also be referred to as axial movement, i.e., movement of block 11 along the breechward-muzzleward axis of the torpedo tube 20. Slots 23*a* and 23*b* also cant block 11 in a direction substantially perpendicular to the breechward-muzzleward axis when block 11 is moved axially. For the load position shown in FIG. 1, breechward section 11*a* is raised up as block 11 moves toward the breechward end 20*a* or muzzleward section 11*b* remains lowered in the housing 12.

As a weapon 30, shown only in section, is loaded into the breechward end 20*a* of a tube 20, a weapon guide stud passes under breechward section 11*a* and comes to rest against a muzzleward section 11*b*. As the weapon 30 is pushed into the tube toward the muzzleward end 20*b*, section 11*a* is canted down so that a guide slot 11*d* engages the guide stud 31.

Block 11 is mechanically connected to a hydraulic control system 100 shown schematically in FIG. 1. While the invention is being described using a hydraulic control system 100, it is not so limited. The control system functions could just as easily be achieved using any one of a manual, pneumatic, mechanical, or solenoid operated control system. Mechanical connection of control system 100 to block 11 is indicated generally by the line of small circles 200. Specifically, an axial restraining block power cylinder 101 is connected to block 11. Power cylinder 101 is shown aligned in the same orientation as block 11, i.e. the load position. Control system 100 also has a breechward power cylinder lock 102 and a muzzleward power cylinder lock 103. Both breechward and muzzleward locks 102 and 103 are also power cylinders. Locks 102 and 103 are used to limit the amount of movement of power cylinder 101 toward the breechward and muzzleward ends 20*a* and 20*b*, respectively.

The position of all three cylinders 101, 102, and 103 is controlled by hydraulic pressure applied by a pressure source 110 through pressure (P)/return (R) lines 111 when the pressure source 110 receives a control signal. For the load position shown in FIG. 1, hydraulic pressure is applied to cylinders 101, 102, and 103 as indicated by the respective pressure arrows 101A, 102A and 103A. Check valves 112 are used to prevent hydraulic pressure from being directly applied to power cylinder 101. Accordingly, hydraulic pressure reaches power cylinder 101 through cylinder lock 102 as cylinder lock 102 is retracted. This prevents the hydraulic cylinders from jamming against one another. As a result, breechward lock 102 is raised out of the way of power cylinder 101 to permit the necessary movement of power cylinder 101. Power cylinder 101 then moves block 11 toward breechward end 20*a* of torpedo tube 20. In contrast, muzzleward lock 103 is positioned to limit the muzzleward movement of power cylinder 101 and, in turn, limit muzzleward movement of block 11 toward the muzzleward end 20*b*. Thus, block 11 is properly positioned for the loading of a weapon 30 into the torpedo tube 20 and at the same time would restrict the undesirable movement of the weapon toward the muzzleward end 20*b* of tube 20.

Figure 2:
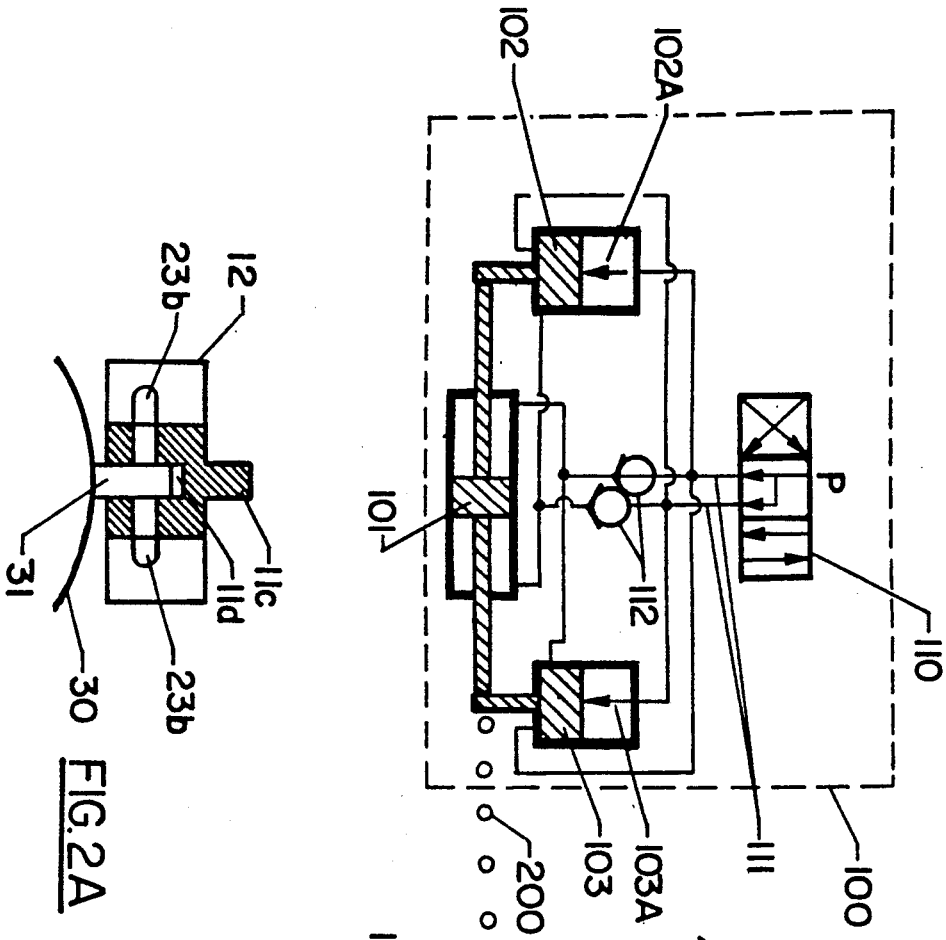
FIG. 2 is a schematic of the present invention in the lock position.
Figure 2A:
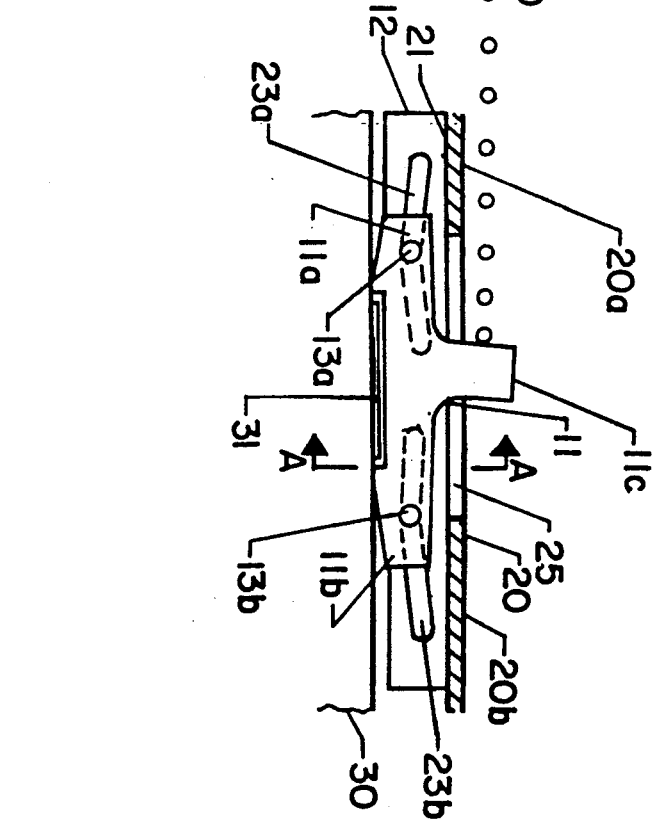
FIG. 2*a* is a cross-sectional view of the restrainer of FIG. 2 along line A—A.

Once the weapon has been loaded into the tube 20, the restraining system 10 is switched to a lock position as shown in FIG. 2 in response to a lock control signal. Like reference numerals will apply between the common elements of FIGS. 1 and 2. In response to the lock control signal, hydraulic system 100 is pressurized to reposition block 11 so that block 11 restrains a weapon from axial movement within the tube 20. In order to better illustrate the locking function of block 11, FIG. 2A is provided as a cross-sectional view looking along line A—A in FIG. 2. As shown, guide slot 11*d* is cut out between sections 11*a* and 11*b*. Guide slot 11*d* is used to engage guide stud 31 of the weapon 30. In the lock position, cam slots 23*a* and 23*b* position block 11 so that sections 11*a* and 11*b* fixably engage themselves around guide stud 31.

Breechward and muzzleward locks 102 and 103, respectively, are pressurized in the lock position as shown by pressure arrows 102A and 103A. Thus, locks 102 and 103 limit the amount of movement of power cylinder 101 and block 11 toward either the breechward or muzzleward end 20*a* and 20*b*, respectively. Check valves 112 prevent hydraulic pressure from being directly applied to power cylinder 101. Locks 102 and 103 also present hydraulic pressure from being applied to power cylinder 101 in this position since both locks 102 and 103 are blocking the pressure lines leading two power cylinder 101.

Figure 3:
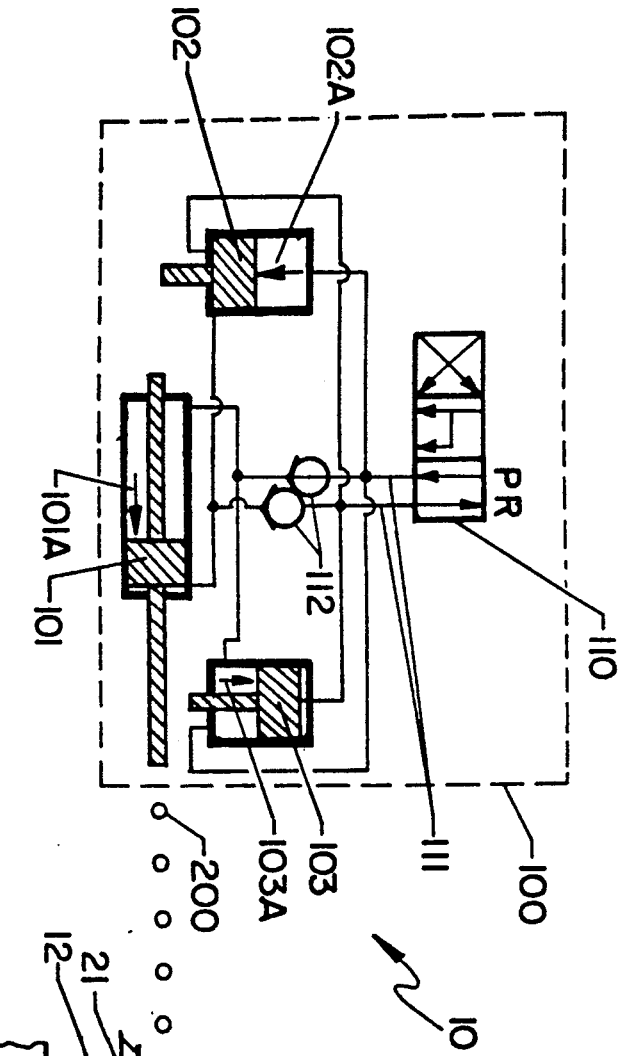
FIG. 3 is a schematic of the present invention in the fire position.

Upon receiving a fire control signal, the restraining system 10 is switched to the fire position as shown in FIG. 3. Once again, like reference numerals will apply between common elements in FIGS. 1, 2 and 3. In response to the fire control signal, hydraulic system 100 is pressurized to 1) prevent the weapon from moving toward the breechward end 20*a* and 2) to reposition the lock 103 so that block 11 releases a weapon toward the muzzleward end 20*b*. Once again, to prevent jamming of the system 10, hydraulic pressure is applied to power cylinder 101 through muzzleward lock 103. Check valves 112 prevent the direct application of hydraulic pressure to power cylinder 101.

To accomplish the dual function in the fire mode, hydraulic system 100 pressurizes cylinders 101, 102 and 103 as shown by pressure arrows 101A, 102A and 103A. The first function of the restraining system 10 during firing is to prevent the weapon from moving breechward in the torpedo tube. As discussed above, breechward movement of the weapon in the torpedo tube at firing time is possible since there is a greater hydrostatic pressure head at the torpedo tube muzzle door than at the ejection pump door. To prevent such breechward movement of the weapon, breechward lock 102 is pressurized to limit the amount of movement of power cylinder 101 and block 11 toward the breechward end 20*a*. Thus, even if the weapon started to move breechward, breechward lock 102 prevents power cylinder 101 and block 11 from moving past the lock position.

For the second function of the restraining system during firing, muzzleward lock 103 is pressurized to permit movement of power cylinder 101 and block 11 toward muzzleward end 20*b* thereby releasing the weapon. As block 11 moves toward the muzzleward end 20*b*, cam slots 23*a* and 23*b* lift block 11 up and out of the way of guide stud 31 as the weapon 30 moves toward the muzzleward end 20*b*. Note that both sections 11*a* and 11*b* are lifted up during firing.

Figure 4:
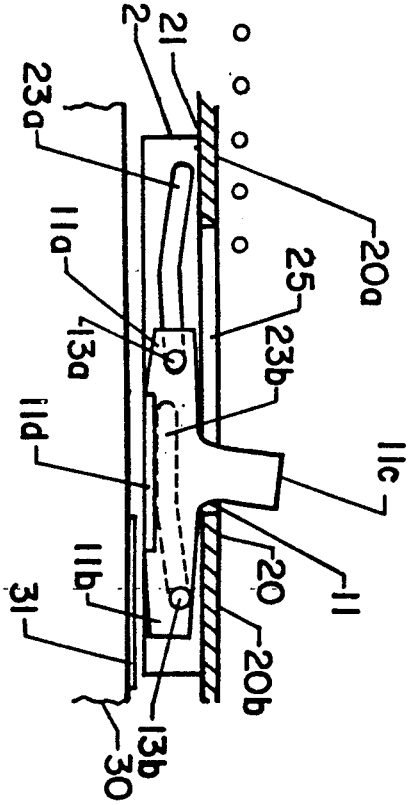
FIG. 4 is an alternative configuration of the restrainer of the present invention as it engages a weapon guide stud.
Figure 4:
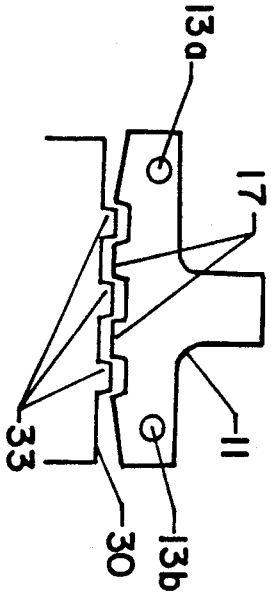

Finally, although the invention has been specifically described above, it is not so limited. FIG. 4 illustrates at least one alternative lock/guide stud arrangement. Block 11 might have a series of teeth 33 in place of a guide slot 11*d*. Teeth 33 will fixably engage with teeth 33 on a weapon guide stud 31. Such an arrangement could reduce guide stud bearing stress. In addition, a hydraulic control system could be replaced with any one of a number of control systems mentioned above.

The advantages of the present invention are numerous. The axial restraining system of the present invention will not permit a weapon to move breechward due to a pressure imbalance across the forward and aft portions of the weapon. It is relatively simple and is small enough to be a minimum flow restriction during the firing of the weapon. Thus, it will be understood that various changes in the details, materials, steps and arrangement of parts, which have been herein described and illustrated in order to explain in the nature of the invention, may be made by those skilled in the art within the principle and scope of the invention as expressed in the appended claims.

What is claimed is:

1. An axial weapon restraining system for a submarine torpedo tube, the torpedo tube having a breechward end and a muzzleward end, comprising:

an axial weapon restrainer for maintaining the axial position of a weapon in the torpedo tube; and means mechanically connected to said restrainer for moving said restrainer to one of a load, lock or fire positions wherein said restrainer a) permits loading of a weapon into the torpedo tube when in said load position, b) restrains the weapon from axial movement in the torpedo tube when in said lock position, and c) permits movement of the weapon towards the muzzleward end of the torpedo tube when in said fire position, wherein the weapon is prevented from moving towards the breechward end of the torpedo tube in said lock position or during the initial restrainer movement stage of said fire position and prevented from moving towards a muzzleward end of the torpedo tube in either of said lock or load positions.

2. An axial weapon restraining system as in claim 1 wherein said moving means comprises:

a first power cylinder fixably attached to said restrainer for moving said restrainer in an axial direction toward the breechward end in said load position and toward the muzzleward end of said fire position;

a second power cylinder in mechanical communication with said first power cylinder for controlling the amount of movement of said first power cylinder toward the breechward end of the torpedo tube in said lock and fire positions;

a third power cylinder in mechanical communication with said first power cylinder for controlling an amount of movement of said first power cylinder toward a muzzleward end of the torpedo tube in said lock and load positions; and means for controlling said first, second and third power cylinders in response to a control signal, said control signal requesting one of said load, lock or fire positions.

3. An axial restraining system as in claim 2 wherein said controlling means comprises a hydraulic control system.

4. An axial restraining system as in claim 2 wherein said controlling means comprises a pneumatic control system.

5. An axial restraining system as in claim 2 wherein said controlling means comprises a manual control system.

6. An axial restraining system as in claim 2 wherein said controlling means comprises a mechanical control system.

7. An axial weapon restraining system as in claim 2 wherein said controlling means comprises a solenoid operated control system.

8. An axial weapon restraining system as in claim 3 wherein said hydraulic control system comprises:

means for applying hydraulic pressure 1) to said first, second and third power cylinders when said control system receives said load control signal wherein the hydraulic pressure causes said second power cylinder to permit said first power cylinder to move toward the breechward end and said third power cylinder to limit the amount of movement of said first power cylinder toward the muzzleward end, 2) to said second and third power cylinders when said control system receives said lock control signal wherein the hydraulic pressure closes said second power cylinder to limit the amount of movement of said first power cylinder toward the breechward end and closes said third power cylinder to limit the amount of movement of said first power cylinder toward the muzzleward end, and 3) to said first, second and third power cylinders when said control system receives said fire control signal wherein the hydraulic pressure causes said third power cylinder to permit said first power cylinder to move toward the muzzleward end and said second power cylinder to limit the amount of movement of said first power cylinder toward the breechward end.

9. An axial weapon restraining system as in claim 8 wherein said hydraulic control system further comprises a plurality of check valves wherein said check valves are positioned in said hydraulic control system to prevent direct application of the hydraulic pressure to said first power cylinder wherein hydraulic pressure is applied to said first power cylinder 1) through said second power cylinder response to said load control signal and 2) through said third power cylinder in response to said fire control signal.

10. An axial weapon restraining system for a submarine torpedo tube having a breechward end and a muzzleward end, comprising:

a housing mounted on a wall of the torpedo tube, said housing having cam slots contained therein;

an axial weapon restrainer mounted within said housing, said restrainer forming a guide slot that extends into the torpedo tube for engaging a guide stud on a weapon in the torpedo tube, said restrainer further having guide pins that extend into said cam slots wherein said cam slots permit simultaneous movement of said restrainer in both an axial direction of the torpedo and in a direction perpendicular to a centerline axis to the torpedo tube wherein said guide slots receive the guide stud when the weapon is loaded, engage the guide stud when the weapon is stowed, and disengage the guide stud when the weapon is fired;

means mechanically connected to said restrainer for moving said restrainer towards the breechward end of the torpedo tube as guided by said cam slots when the weapon is to be loaded into the torpedo tube from the breechward end wherein said guide slot is positioned by said cam slots to receive the weapon guide stud and restrict the weapon guide stud from moving past said restrainer toward the muzzleward end, said means further for moving said restrainer towards the muzzleward end as guided by said cam slots when the weapon is to be fired from the torpedo tube at the muzzleward end wherein said guide slot is initially positioned by said cam slots to restrict the weapon guide stud from moving past said restrainer toward the breechward end and then to release the weapon guide stud toward the muzzleward end; and means for locking said moving means when the weapon is in the torpedo tube wherein said guide slot of said restrainer is positioned by said moving means to fixably engage the weapon guide stud whereby the weapon is prevented from moving towards either the breechward or muzzleward end.

11. An axial weapon retraining system as in claim 10 wherein said guide slot is toothed guide slot for engaging a toothed weapon guide stud.

* * * * *